US005800090A

United States Patent [19]

Goughnour

[11] Patent Number: 5,800,090

[45] Date of Patent: Sep. 1, 1998

[54] APPARATUS AND METHOD FOR LIQUEFACTION REMEDIATION OF LIQUEFIABLE SOILS

[75] Inventor: R. Robert Goughnour, Leesburg, Va.

[73] Assignee: Geotechnics America, Inc., Matthews, N.C.

[21] Appl. No.: 630,001

[22] Filed: Apr. 9, 1996

[51] Int. Cl.[6] ..... E02D 3/08; E02D 3/10

[52] U.S. Cl. ..... 405/36; 405/52; 405/258

[58] Field of Search ..... 405/36, 50, 51, 405/52, 258

[56] References Cited

U.S. PATENT DOCUMENTS

| | | | |
|---|---|---|---|
| 3,638,433 | 2/1972 | Sherard | 405/50 |
| 4,003,210 | 1/1977 | Bostroem | 405/171 X |
| 4,040,263 | 8/1977 | Eide et al. | 405/195.1 |
| 4,124,982 | 11/1978 | Fuller | 405/36 X |
| 4,685,835 | 8/1987 | Massarsch | 405/258 X |
| 5,213,449 | 5/1993 | Morris | 405/50 X |
| 5,282,699 | 2/1994 | Hodge | 405/50 X |

OTHER PUBLICATIONS

By H. Bolton Seed, M. Asce and John R. Booker Stabilization of Potentially Liquefiable Sand Deposits Using Gravel Drains. Jul. 1977.

Shima, M. and Miura, H. (1991) "A New Improvement Method for Loose Sand with Flexible Polyethylene Drain Pipe."

Dr. Helwany, Project Desription Liquefaction Prevention Utilizing Spiral and Wick Drains (undated).

*Primary Examiner*—George A. Suchfield

*Attorney, Agent, or Firm*—Carothers & Carothers

[57] ABSTRACT

Liquefiable soil is treated for earthquake liquefaction protection prior to erecting a building structure or work. A plurality of substantially vertical prefabricated drains are positioned at spaced intervals in the liquefiable soil and a reservoir is provided and adapted for draining off water which is expelled from the drains during an earthquake. The drains are generally comprised of an elongated plastic core material providing channels for channeling water off or therealong and this core is sometimes or selectively surrounded by a filter fabric as required to provide a composite drain.

31 Claims, 7 Drawing Sheets

APPARATUS AND METHOD FOR LIQUEFACTION REMEDIATION OF LIQUEFIABLE SOILS

BACKGROUND OF THE INVENTION

This invention relates generally to soil stabilization, and more particularly to liquefaction remediation of liquefiable soil to minimize damage to supported structures or works from earthquake-induced liquefaction.

Earthquakes are caused by sudden breaks in the earth's crust. In certain portions of the world there appears to be a continuous movement between one section of the earth's crust and an adjacent one, causing an accumulation of strain at these boundaries. When the stresses developed by such strain reach the strength of the materials, a slip occurs between the two portions of the crust and tremendous amounts of energy are released. This energy propagates outward from the focus or origin of the earthquake in the form of elastic stress waves which can carry destructive amounts of energy for hundreds of miles.

One of the most destructive effects of these stress waves results from their effect on deposits of saturated loose fine sand or silty sand, causing a phenomenon known as liquefaction. When liquefaction occurs the soil mass loses all shear strength and behaves temporarily as a liquid. Such temporary loss of shear strength can have catastrophic effects on earthworks or structures founded on these deposits. Major landslides, lateral movement of bridge supports, settling or tilting of buildings, and failure of waterfront structures have all been observed in recent years, and efforts have been increasingly directed toward development of methods to prevent or reduce such damage.

Any impact or shock on or within the upper portion of the earth's crust causes stress waves to be transmitted through the soil. Any or all of a number of different types of waves are possible, and which of these waves actually occur depends on the location, type and configuration of shock or impact. Seismologists have identified two classes of such earth waves; body waves which travel through the interior of a mass, and surface waves which travel along the surface.

Body waves travel through the interior of a medium and radiate outward in all directions from a disturbance. In an earthquake the original slip occurs in a relatively localized vicinity in the bedrock below the earth's surface, and the wave front is essentially spherical. As the waves travel farther and farther from the source the curvature of the wave front becomes less and less, and at a great distances from the source the wave front will be indistinguishable from a plane wave.

The two types of body waves are compressional or longitudinal, called P-waves, and shear or transverse waves, called S-waves.

Surface waves occur at the surface of an elastic medium, or at the interface of two elastic media of differing properties. Particle motions associated with this type of wave are confined to a relatively thin region close to the surface or interface. Surface waves propagate outward from the source with a circular wave front. Again, as the wave front travels farther and farther from the source the curvature of the wave front becomes less and less.

The surface waves of most interest are the Rayleigh wave and the Love wave. Two other waves called the coupled wave and the hydrodynamic wave die out rapidly as they proceed from the source.

The total energy transported is represented almost entirely by the Rayleigh, the S-, and the P-waves, with the Rayleigh wave carrying the largest amount of energy, the S-wave an intermediate amount, and the P-wave the least. The velocity of the P-wave is almost double that of the Rayleigh and S-waves, and the velocity of the S-wave is only slightly greater than that of the Rayleigh wave.

At some distance from a disturbance a particle at the earth's surface first experiences a displacement in the form of an oscillation at the arrival of the P-wave followed by a relatively quiet period leading up to another oscillation at the arrival of the S-, and Rayleigh waves. These events are referred to as the minor tremor, and major tremor at the time of arrival of the Rayleigh wave.

The time interval between arrivals becomes greater and the amplitude of oscillation becomes smaller with increasing distance from the source. In addition, the minor tremor decays more rapidly than the major tremor. It is evident, therefore, that the Rayleigh wave is the most significant disturbance along the surface of the elastic half-space, and at large distances from the source may be the only clearly distinguishable wave.

Real earth motions are actually quite complex, due to the variation between a homogeneous elastic medium and the real earth. When elastic waves impinge on an interface between differing elastic media, at least a part of the energy is reflected back from the interface in the form of a reflected wave. When multiple interfaces are present the wave pattern can become extremely complex.

Further, considerable energy can be transmitted through the bedrock itself, and it appears that in many cases the main forces acting on soil elements in the field during earthquakes are those resulting from the upward propagation of shear motions from the underlying rock formations. Although the actual wave pattern may be very complex, the resulting repeated and reversing shearing deformations imposed on the soil by the shear wave components are the principal cause of liquefaction in saturated fine sand or silty sand deposits.

When loose sand is subjected to repeated shear strain reversals, the volume of the sand will decrease with each reversal, although the amount of volume decrease becomes less with each cycle. If the sand is saturated and drainage out of the sand is prevented, it will be understood that since the volume of the sand is decreasing, the pressure of the water must increase. As the water pressure becomes greater the grain-to-grain contact pressure in the sand must become smaller and smaller. When this grain-to-grain contact pressure becomes zero, the entire sand mass will lose all shear strength and will act as a liquid. This phenomenon is known as liquefaction and can occur in loose, saturated sand deposits as a result of earthquakes, blasting, or other shocks.

The factors that effect the occurrence of liquefaction are soil type, compactness of the soil, soil permeability, magnitude of the strain reversals, and number of strain reversals.

Fine cohesionless soils (fine sands) or fine cohesionless soils containing moderate amounts of silt are most susceptible to liquefaction. There is some evidence to show that uniformly graded materials are more susceptible to liquefaction than well graded materials, and that for uniformly graded soils, fine sands tend to liquefy more easily than coarse sands, or gravely soils. Moderate amounts of silt appear to increase the liquefaction susceptibility of fine sands. Although fine sand with larger amounts of silt are not as susceptible, liquefaction is still possible.

Recent evidence indicates that sands containing up to 20% clay may also be liquefiable.

Typical values of soil permeability are shown in Table 1. The wide range of permeability for various materials is shown.

TABLE I

RELATIVE VALUES OF PERMEABILITY.

| Relative permeability | Values of k (cm/sec) | Typical soil |
|---|---|---|
| Very Permeable | Over $1 \times 10^{-1}$ | Coarse gravel |
| Medium permeability | $1 \times 10^{-1}$ to $1 \times 10^{-3}$ | Sand, fine sand |
| Low Permeability | $1 \times 10^{-3}$ to $1 \times 10^{-5}$ | Silty sand, dirty sand |
| Very low permeability | $1 \times 10^{-5}$ to $1 \times 10^{-7}$ | Silt |
| Impervious | Less than $1 \times 10^{-7}$ | Clay |

To correct to feet per minute, multiply the above values by 2; to convert to feet per day, multiply the above by $3 \times 10^3$.

During an earthquake, shear strain reversals in the soil result principally from the passage of S-waves. The magnitude and number of these shear strain reversals depend on the magnitude and duration of the earthquake.

As a result of the shear strain reversals cohesionless soils will experience volume reduction. In deposits below the water table volume reduction will cause water to flow out of the vicinity where the volume reduction is taking place. Depending on the permeability of the soil, this flow will be impeded, with a resulting increase in pressure within the pore water. As the pressure within the pore water becomes greater, the gain-to-grain contact pressure will disappear, and the mass will lose all shear strength, i.e. liquefaction occurs.

In very coarse sands or gravels water can flow freely enough that pore water pressures never become dangerously high. At greater depths grain-to-grain contact pressures are initially greater, and pore water pressures must become greater for liquefaction to occur. In dense material more strain reversals must occur to provide sufficient volume decrease to cause liquefaction.

Cohesive materials (clays) respond differently to shear strain, and in general are not susceptible to liquefaction. Recent evidence indicates that under some conditions sands containing up to 20% clay may lose strength during an earthquake.

Treatments for controlling liquefaction consist of one of four general methods:

1. remove material subject to liquefaction and replace with sound material.
2. provide structural support to underlying firm soil strata, i.e. piling.
3. densify the material so as to render it less susceptible to liquefaction.
4. provide drainage to prevent build up of pore water pressures, and/or provide strength reinforcement to the soft liquefiable soils.

Physically removing the soil material susceptible to liquefaction and replacing it with sound material is one of the most positive methods of controlling liquefaction. Unfortunately it is also one of the most expensive, often prohibitively so. Complications arise because these deposits are always below the ground water table and often as deep as 50 to 60 feet.

Another solution to the liquefaction problem is to found the structure on piling driven through the susceptible soils to firm underlying material. However, such firm underlying material is often quite deep. Besides being expensive this method is not entirely satisfactory because the soil between the piling can still liquefy. If such liquefaction occurs the piling is left without lateral support and danger of buckling exists.

One of two methods are normally used for deep densification, namely, deep vibratory compaction and dynamic compaction.

Deep vibratory soil compaction devices, which includes vibroflotation, TERRA-PROBE (Trademark), VIBRO-WING (Trademark), and others, is most effective in clean sands, and under the proper conditions may be the most positive and cost effective method of controlling liquefaction. Unfortunately, only a small percentage of the soils susceptible to liquefaction are appropriate for treatment by deep vibratory compaction, because the presence of appreciable amounts of silt or clay renders the process ineffective. The stone column method might be thought of as an extension of vibroflotation. This method will be discussed later. Typical costs for deep vibratory compaction range from $1.00 to $5.00 per cubic yard of material treated. Treatment has been accomplished to depths in excess of 100 feet.

Dynamic compaction is accomplished by repeatedly dropping heavy weights (4 to 35 tons) onto the ground surface from heights of 20 to 120 feet. Although this method is effective in materials containing significant amounts of silt or clay, there are depth limitations. The depth to which densification is achieved depends on the how large a weight is used. For weights of 20 to 35 tons the process is limited to 30 to 35 feet in clean sands, and in materials containing significant amounts of silt or clay may be limited to 20 feet or less. For weights up to 20 tons the depth limitation in clean sands is on the order of 15 to 20 feet, and may be only 10 feet or so in dirty materials.

Very large and specialized equipment is required for weights greater than 20 tons, and both mobilization and production costs are drastically increased. These large weights are practical for only very large projects.

If the soil to be treated is very soft or if the ground water table is near the surface it is necessary to install a "buffer" pad of granular material 5 to 7 feet thick to drop the weight on to. This buffer pad distributes the shock loads of the falling weight to the underlying soil to be densified, and also raises the operation to a level where the craters created remain above ground water level.

The process is also severely limited in congested areas because of the detrimental effect on adjacent works from the impact of the weight as it strikes the ground.

Under the proper conditions this method is very cost effective and positive. Typical costs may range from $0.50 to $6.00 per cubic yard of material treated.

Stone columns, as the name implies, are simply vertical columns of compacted stone extending through a deposit of soft soil. The most common method of installing stone columns, developed in Germany in the late 1950's is a natural extension of the vibroflotation process, and uses modified vibroflotation equipment. Another technique, developed concurrently in Japan often utilizes sand instead of stone. Another recently developed method, ROTOCOL-UMN (Service Mark), produces very clear and uncontaminated columns.

Stone columns are installed on a regular pattern over the area to be treated, and provide reinforcement, resulting in increased vertical load capacity as well as improved composite shear resistance. Stone columns have been used to improve a wide range of soils, from very soft clays to materials marginally suitable for vibroflotation or deep vibratory compaction. In mixed soils improvement can be gained in the cleaner, cohesionless material, while the column provides reinforcement in those areas that do not respond to vibratory compaction. The permeable vertical stone column also provides an effective drainage path for dissipation of excess pore water pressures.

The concept of stone columns or gravel drains to prevent dangerous buildup of pore water pressures in controlling liquefaction was first quantified by Seed and Booker (Seed, H. B. and J. R. Booker, "Stabilization of Potentially Liquefiable Sand Deposits Using Gravel Drains," Journal of the Soil Mechanics and Foundations Division, A.S.C.E., Vol. 103, No. GT7, July, 1977). Both gravel drains and stone columns are installed on a regular pattern over the area to be treated, and to such a depth as to penetrate the liquefiable soils. An escape path for drainage of pore water is provided from the top of the columns. This usually takes the form of a stone layer which in turn drains into a sewer system or "daylights" to the ground surface (See FIG. 1).

By this method the excess water pressures within the gravel columns or drains are maintained at a very low level. Excess pore water pressures generated within the intervening soil will dissipate rapidly because the drainage path to the nearest column or drain is relatively short.

In the Seed-Booker analysis, excess pore pressures within the columns or drains are assumed to be zero. This condition cannot strictly be met in practice because the water level within the column must rise above the ground water level for drainage out of the column to occur. Further, vertical movement of water within the stone column or gravel drain generates head losses with resulting back pressures.

The tributary area surrounding each column is idealized to a circle with a radius chosen to produce a circle with area equivalent to the actual tributary area. The analysis then considers the drainage and pressure conditions within a cylinder of soil containing a gravel column at its center. In the analysis no drainage is allowed across the outside surface of this cylinder of soil, and the excess pore water pressure is considered to be zero at its inside radius, or at the interface with the gravel column. The Seed-Booker analysis is based on these assumptions, and presents a series of charts and graphs convenient for design of gravel drains to limit excess pore pressures to a desired level for earthquakes of various magnitudes and durations. A computer program (PROGRAM LARF by trademark) is available for solution of the equations.

Another computer program (EQDRAIN) has been written to study the effect of head losses produced by water flow within the drain, and the effect of a rising water level within the drain. This program can handle variable thicknesses and depths below the surface of the liquefiable soil. It is intended that this program will be refined to accommodate liquefiable soils with properties that vary with depth. This program will be available for design use.

Typical stone column diameters range from 2 to 5 feet, and typical gravel drain diameters range from 8 inches to 18 inches. Typical spacings for stone columns range from 4 feet to 10 or 12 feet, and spacings of gravel drains ranges from 2 to 6 or 7 feet. This wide range of values reflects the effect of varying soil materials and severity of earthquake designed for.

The cost of stone columns ranges from about $15.00 to $30.00 or more per foot. Gravel drains range from $2.50 to $5.00 per foot. This equates to a cost per cubic yard of material treated of $3.50 to as much as $25.00 to $30.00 for stone columns, and $2.00 to $15.00 for gravel drains. In addition a cost of from $1.00 to $3.00 per square foot of surface area must be added for a surface drainage system for drains, or for a stress distribution mat for stone columns.

SUMMARY OF THE INVENTION

The apparatus and method of the present invention for treating liquefiable soil for earthquake liquefaction protection for a structure or work thereon, comprises a plurality of substantially vertical prefabricated composite drains positioned at spaced intervals in the liquefiable soil, and a reservoir which is adapted for draining off water that is expelled from these composite drains. The object is to provide pore water pressure relief from a series of spaced locations within a liquefiable soil by providing an open drainage path which operates as efficiently as possible—i.e. requires as little pressure as possible to move the required amount of water.

The liquefiable soils being treated, and most susceptible to liquefaction, are fine cohesionless soils (fine sands) or fine cohesionless soils containing moderate amounts of silt. More specifically such liquefiable soils have a permeability in the approximate range of $1\times10^{-2}$ to $1\times10^{-6}$ cm/sec, as opposed to very permeable soils, such as coarse gravel which has a permeability of over $1\times10^{-1}$ cm/sec or impervious soils, such as clay, which have a permeability of less than $1\times10^{-7}$ cm/sec.

The composite drains are comprised of an elongated plastic core providing channels therein for channeling water therealong and this core is surrounded by a geofabric or filter fabric. An advantage of the geofabric is that it will not be subject to plugging or to silt build-up since the drain is not used until an actual earthquake or other heavy shocks occur to the liquefiable soil. This geofabric is provided with opening sizes such as to prevent the entrance of soil particles but allows pore water to freely enter.

The elongated plastic core of the composite drain structure, in one form, includes a flexible strip of material having lateral stand-off protrusions providing drainage channels therebetween. In another version, the elongated plastic core may be constructed of corrugated and perforated plastic pipe, which is surrounded by the geofabric. In some instances the geofabric may be omitted from the corrugated, perforated plastic pipe.

Approximate dimensions range from ½ to 2 inches thick by 4 to 18 inches wide in the case of the formed plastic core, and from 1½ inches to 8 or 10 inches inside diameter in the case of the plastic pipe. These products can all convey large amounts of water at very low pressure gradients.

The vertical drains are spaced in the general range of 2 to 6 feet. This spacing depends not only upon the permeability and compressibility of the liquefiable soil, but also upon head losses involved in moving the water from its point of entrance into the drain to its final discharge into the reservoir. This obviously involves head losses incurred from vertical flow within drains. It also involves head losses incurred in entering the reservoir, as well as the head required to lift the water to the level of the reservoir, if this level is above that of the static ground water table.

Suitable reservoirs may be in the form of an existing naturally available reservoir or a man made reservoir as required. For example, the layer of liquefiable soil being treated may possibly overlie a bed of highly permeable soil or course sand. In this instance, the vertical composite drains are inserted in such a way that they entirely penetrate the liquefiable soil and enter into the underlying bed of highly permeable soil. Accordingly, when water pressure or head pressure within the drains builds up during an earthquake, it is quickly drained off to the underlying reservoir.

Another such reservoir which is readily available in many instances occurs when the ground water surface exists within a highly permeable soil or aquifer overlying the liquefiable soil. The vertical drains may be so implanted to drain off into this naturally occurring aquifer. In both cases the ground water level will temporarily rise nominally when discharge from the drains occurs.

When a suitable naturally occurring or available reservoir is not present, a reservoir may often be constructed by placing a 1- to 4-foot layer of highly permeable soil or gravel on the ground surface above the liquefiable soil. The structure or work is built over this layer of permeable material. The vertical drains are placed so as to conduct the expelled water to the surface, and the void spaces within the permeable layer provide the required reservoir. The water deposited in these void spaces then gradually seeps away after a seismic event.

The ground surface will normally be at some distance above the static ground water level, and the pressure head required to lift the water from this level to the surface will be applied as back pressure to pore water trying to enter the drains from the liquefiable soil. This will obviously affect the amount of water expelled from the soil, and in turn the spacing of the vertical drains required to maintain excess pore water pressures within the soil to a desired level. The amount of back pressure that can be tolerated is interrelated with all of the other factors involved in the design.

Soil permeability and compressibility, the magnitude and duration of the seismic event designed for, and the factor of safety or the magnitude the excess pore water pressure within the liquefiable soil will be allowed to attain, are generally given and dictate the design requirements. The actual remediation system design then specifies the vertical drain size or cross sectional area (affects head losses of water flow within the drain), drain spacing, and reservoir requirements. These factors are chosen to attain the most cost-effective combination. Normally, the practical limit that the pore water can economically be lifted to the reservoir level is on the order of 2 to 5 or 6 feet.

A suitable, and often preferable, reservoir can also be constructed by augering a hole at each drain location from the ground surface down to the water table surface, and filling this hole with crushed stone or gravel, or other porous material. Under this arrangement the elevation head difference between the static ground water level and the reservoir is initially zero, and increases only nominally as water enters into the reservoir. This rise of water level within the reservoir is accounted for in the design procedure. The diameter of this augered hole may be in the range of 2 to 4 feet.

In another form this reservoir may consist of a section of pipe buried in a vertical position, with its lower end at the ground water surface. The drains are arranged to terminate at their upper ends inside the reservoir so created. The upper end of the reservoir pipe is covered by a plug or end cap. Although several different materials could be used for such a reservoir, corrugated plastic is normally preferred. The inside diameter ranges from 8 inches to about 2 feet.

When vertical prefabricated drains are used for liquefaction remediation in combination with piling, the piling can be constructed to include reservoir space within its interior. For example, steel pipe piling may be used. It is also a simple matter to construct precast concrete piling with internal void spaces.

In some cases, the vertical drains may contain within themselves sufficient void space above the water table to suffice as a cost-effective reservoir.

As an added safety factor, the liquefiable soil may also be compacted by conventional methods either before or after the vertical drains have been inserted; or, since the drain installation equipment often utilizes a vibrating mandrel to facilitate penetration into the earth, it is a simple matter to modify the mandrel to accomplish densification during drain installation. To accomplish this 3 or 4 fins are added radially to the mandrel. Cleats or protrusions are added to the fins to help transmit vibrations to the soil, and thus effect densification. Alternatively, a series of holes cut into the fins can act to efficiently transmit vibrations.

This probe arrangement, without the central installation mandrel, is similar to various types of vibrating probes commonly used for soil densification. Soil densification from a single probe insertion, or compaction point, is greatest near the probe and diminishes with radial distance. In normal vibrocompaction operations it is desirable that this area of influence be as large as possible. Thus, fewer insertions can cover a given area and at a minimum cost. Very large probes with powerful vibrohammers are common for efficient operations.

The time each insertion is left in the ground also affects the resulting densification. The most efficient combination of probe size, compaction point spacing, and time spent at each point is usually found through field tests for each project. Smaller spacings result in a higher level of densification, but higher cost.

In the present case, compaction point spacing will be dictated by drainage requirements, and will be much smaller than for a normal vibrocompaction project. Thus, efficient compaction will be possible with smaller probes, and less time per compaction point. As mentioned previously, this type of densification is effective in relatively clean cohesionless soil only. It is expected that densification will not be effective in soils containing significant amounts of silts or clay. However, drainage supplied by the composite drain will be effective in the dirtier materials. This should be an advantage for sites with mixed soil conditions.

DESCRIPTION OF RELATED WICK DRAIN PRIOR ART

The prefabricated drain soil remediation method and apparatus of the present invention are similar in many respects to the vertical drain method (sometimes called "wick" drains) commonly used to accelerate consolidation of soft clays. Such soft clays are not liquefiable soils or soils subject to earthquake liquefaction, and are therefore not applicable to the teachings of the present invention. A brief discussion of "wick" drains follows.

When loads are placed on the surface of soft saturated clay deposits large settlements often result because of compression of the clay material. This settlement can take place only as pore water is expelled, and since the permeability of the clay is very low this process takes place very slowly. Total settlements of several meters are common and often take years to occur. This time-dependent process is called consolidation. A process called sand drains and surcharging has been used in these cases since the early 1920's. See D. E. Moran, U.S. Pat. No. 1,598,300 (1926). In this process sand drains or columns are installed through the soft clay layer to be treated. These sand drains are placed on a regular pattern in the same manner as the gravel drain layout shown on FIG. 1. Typical spacings range from 4 to 12 feet and sand drain diameters are typically 1 foot and occasionally as much as 2 feet.

After the sand drains are installed a sand drainage blanket 1 to 3 feet thick is placed over the drains to permit water flow out of the drains. An earth embankment is placed over this sand blanket. The thickness of this embankment or surcharge is calculated to produce loading roughly 10% greater than the anticipated final design load planned for the project. Since drainage out of the clay can now flow into the sand drains, the drainage path is much shortened and consolidation occurs much more rapidly. The surcharge is left in place until the consolidation process is nearly complete, typically 6 months or less. The surcharge is then removed and the project proceeds.

In the late 1960's and early 1970's vertical wick drains were developed as an alternative to sand drains. Vertical wick drains are not truly wicks but are composite drains composed of an extruded plastic core, shaped to provide drainage channels when this core is wrapped in a special geofabric. The geofabric is a filter fabric constructed with opening sizes such as to prevent the entrance of soil particles, but allow pore water to enter freely. The finished wick material is band-shaped about ⅛ to ¼ inches thick and typically 4 inches wide. It is provided in rolls containing 800 to 1000 feet of drain. An example manufacturer of wick drains is American Wick Drain Corporation of Matthews, N.C. U.S.A. (AMERDRAIN™).

Installation is accomplished by means of specialized equipment, consisting of a crane mounted vertical mast housing a special installation mandrel (See FIG. 6). The mandrel, containing the drain, is intruded directly into the ground from the bottom of the mast. After reaching the desired depth, the mandrel is withdrawn back into the mast, leaving the undamaged drain in place within the soil. For example, see U.S. Pat. No. 5,213,449.

Typical spacings for vertical wick drains are from 3 to 9 or 10 feet. This method is very cost effective and has virtually replaced the older sand drain method.

Typical per foot costs of vertical wick drains installed ranges from $0.35 to $1.00. This amounts to a cost per cubic yard of material treated of from $0.15 to $2.00. The cost of a surface or horizontal drainage system and surcharge must be added.

BRIEF DESCRIPTION OF THE DRAWINGS

Other objects and advantages appear in the following description and claims.

The accompanying drawings show, for the purpose of exemplification, without limiting the invention or claims thereto, certain practical embodiments illustrating the principals of this invention, wherein:

DETAILED DESCRIPTION OF PREFERRED EMBODIMENTS

Figure 1:
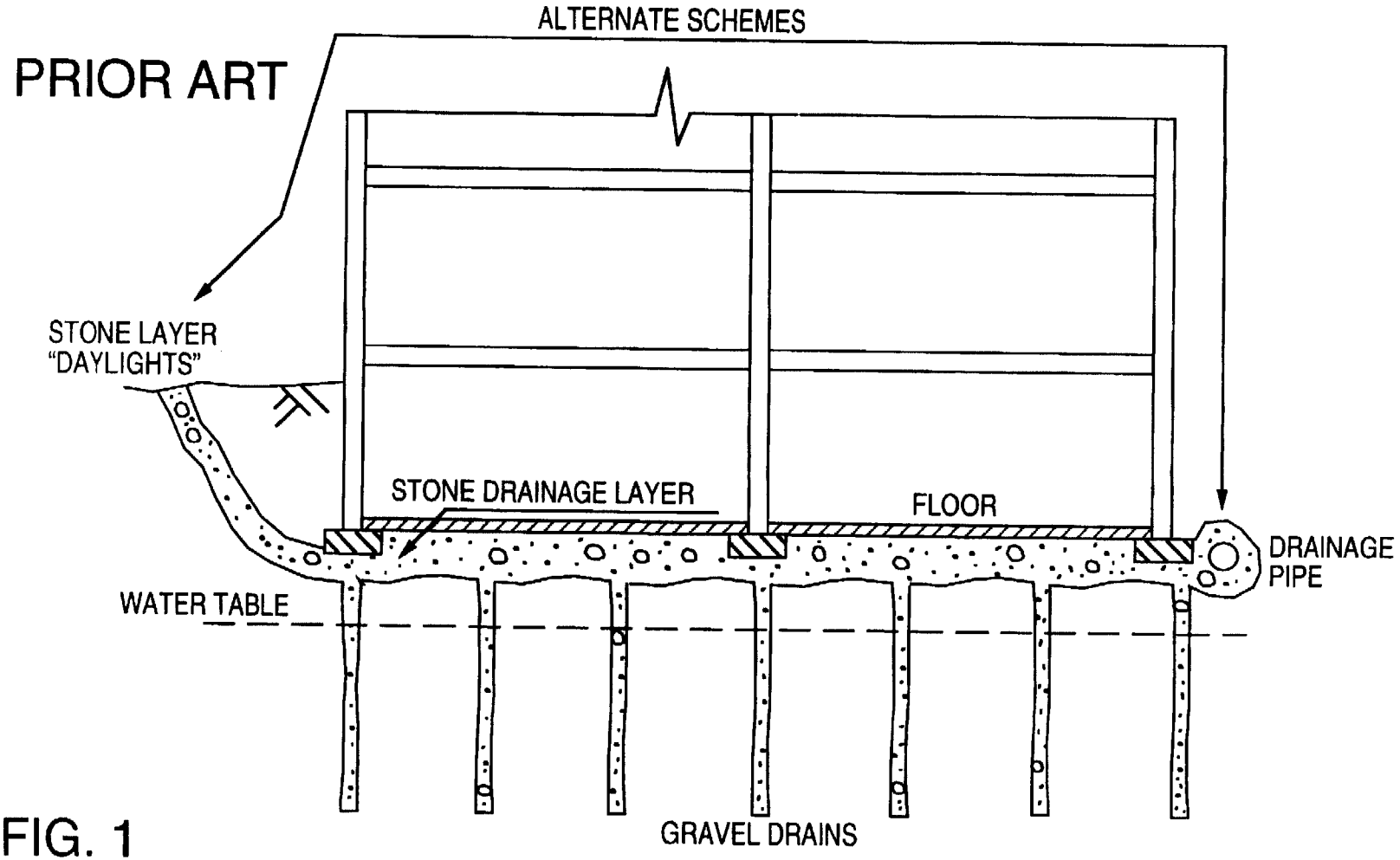
PRIOR ART FIG. 1
FIG. 1 is a schematic view in front elevation and vertical cross section illustrating a building structure supported on liquefiable soil which has been remediated with gravel drain or stone column techniques of the prior art.
Figure 2:
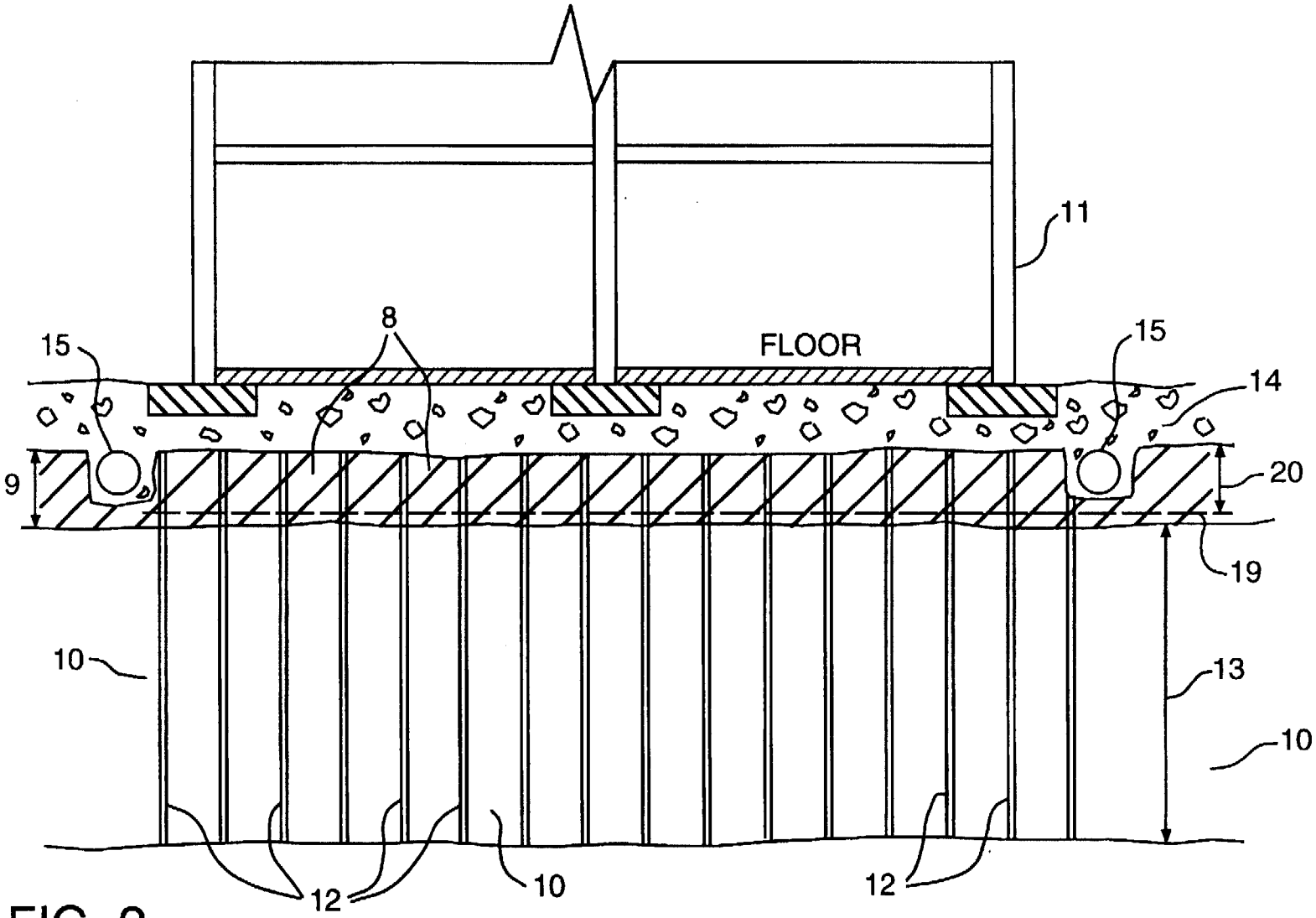
FIG. 2 is a schematic view in front elevation and vertical cross section illustrating a building structure supported on liquefiable soil which has been treated or remediated with the use of prefabricated vertical composite drains in accordance with the teachings of the present invention.

Referring to FIG. 2, liquefiable soil 10 having a permeability in the approximate range of $1\times10^{-2}$ to $1\times10^{-6}$ cm/sec, is treated in accordance with the teachings of the present invention for earthquake liquefaction protection prior to erecting the building structure 11 or work thereon.

A plurality of substantially vertical prefabricated composite drains 12 penetrate the entire depth 13 of the liquefiable soil 10.

Prefabricated composite drains 12 are comprised of elongated plastic cores providing channels therein for channeling water therealong and which are surrounded by filter fabric or geofabric. These composite drains are readily available on the market for purposes other than soil liquefaction remediation.

A number of composite drainage products similar in construction to vertical wick drains have been developed since the early 1980's and are also usable in suitable form in the apparatus and method of the present invention. These products are also constructed of a plastic core surrounded by a geofabric, but have larger cross sectional area than ordinary wick drains. Uses range from drainage around basements to edge drains for highways. One such composite drain is manufactured by the previously cited American Wick Drain Corporation, under the trademark AKWADRAIN. The elongated plastic core of the AKWADRAIN is constructed of a flexible plastic strip having lateral standoff protrusions which provide drainage channels therebetween. Another manufacturer is Burcan Manufacturing Inc. of Whitby, Ontario, Canada, who manufactures a similar product under the trademark "HITEK".

Another recently developed product is corrugated plastic pipe. This product is perforated or slotted and wrapped in a geofabric. In cases where water is expected to flow into the drain only during a seismic event the geofabric may be omitted. The small amount of soil fines carried into the drain during the seismic event will simply settle out later and clog only a few inches of the bottom of the drain. Several events would need to occur to produce significant blockage. Two examples are manufactured by Hancor, Inc. of Findlay, Ohio, U.S.A. and Advanced Drainage Systems, Inc. of Columbus, Ohio, U.S.A. (ADS®). Existing vertical drain installation equipment may be modified to install either of these products as vertical drainage elements.

The prefabricated composite drains 12 as schematically illustrated in FIG. 2 are intended to represent any one of the aforedescribed conventional prefabricated composite drains, or any new designs thereof.

The prefabricated drains 12 in FIG. 2 are uniformly spaced throughout the entire area of liquefiable soil 10 which underlies building structure 11. This spacing will vary anywhere from approximately 2 to 6 feet, depending upon the permeability and compressibility of liquefiable soil 10, the magnitude and duration of the earthquake designed for, the factor of safety, and the type of prefabricated drain 12 employed. Soil 8 is a nonliquefiable soil layer which overlies the liquefiable soil 10.

With the treating apparatus or method of the present invention, a reservoir must also be employed in combination with the vertical prefabricated drains and adapted to drain off water which is expelled from the composite drains. The reservoir may be man made or a naturally occurring reservoir may be utilized when available. In FIG. 2, a man made reservoir 14 is illustrated and is constructed of a layer of compacted gravel. The void space within the gravel forms the reservoir. Drainage pipes 15 are provided to maintain the gravel in a drained condition so that if an earthquake should occur reservoir space will be available. In some cases it will be advantageous to place an impermeable membrane (plastic film or other) over the reservoir to prevent the entrance of outside water.

Thus when an earthquake occurs and water head pressure builds up within the composite drains 12, the water has an immediate free draining means of escape and is permitted to drain off to reservoir 14.

The initial static water level 19 is shown. The distance 20 represents an elevation head that must be overcome in order for water to enter reservoir 14 from the drains 12. The pressure to accomplish this lift must be provided by additional excess pore water pressure within the liquefiable soil 10. The detrimental effect of this added excess pore water pressure can be, within limits, compensated by decreasing the spacing of the drains 12. However, if the distance 20 is too great, the required spacing may become so small as to be impractical, or uneconomical because of the large number of drains. Indeed, the required additional excess pressure may even be greater than the maximum allowable pore water pressure within the liquefiable soil.

Figure 3:
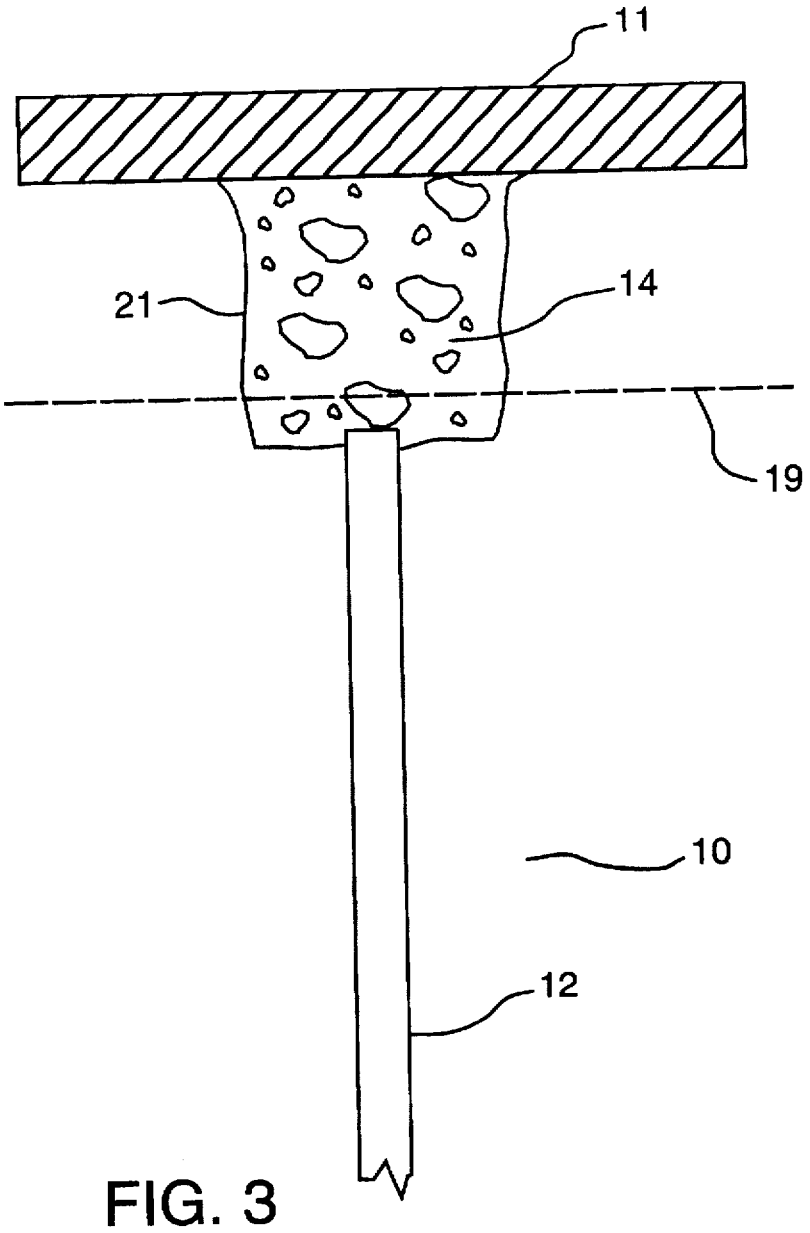
FIG. 3 is a schematic view in vertical cross section of a reservoir constructed by filling an augered hole with stone or other granular material.

FIG. 3 shows an alternative form of man-made reservoir. an augered hole 21 at each drain 12 is filled with crushed rock or other porous material. The interstices of this porous material form the reservoir 14. The overlying structure or work 11 can be founded directly on top of these created reservoirs or placed on top of a layer of fill covering the reservoirs. In this case an impermeable membrane is placed over the top of the reservoirs to prevent contamination of the porous material.

In the event of an earthquake initial conditions will start with the water level in the reservoirs 14 at the initial static ground water level 19, and there will be zero added excess pore water pressure required to lift the expelled water. During the earthquake, flow into the reservoir will exceed the amount of water that can be dissipated out, and the level within the reservoir will rise. Further, the static ground water level will generally vary seasonally and with other factors. The requisite amount of reservoir volume must be provided above the highest expected ground water level. This, along with the required diameter of the augered hole 21, is determined in the design process. After the earthquake the water deposited in the reservoir will gradually drain out and eventually return to the level 19.

Figure 4:
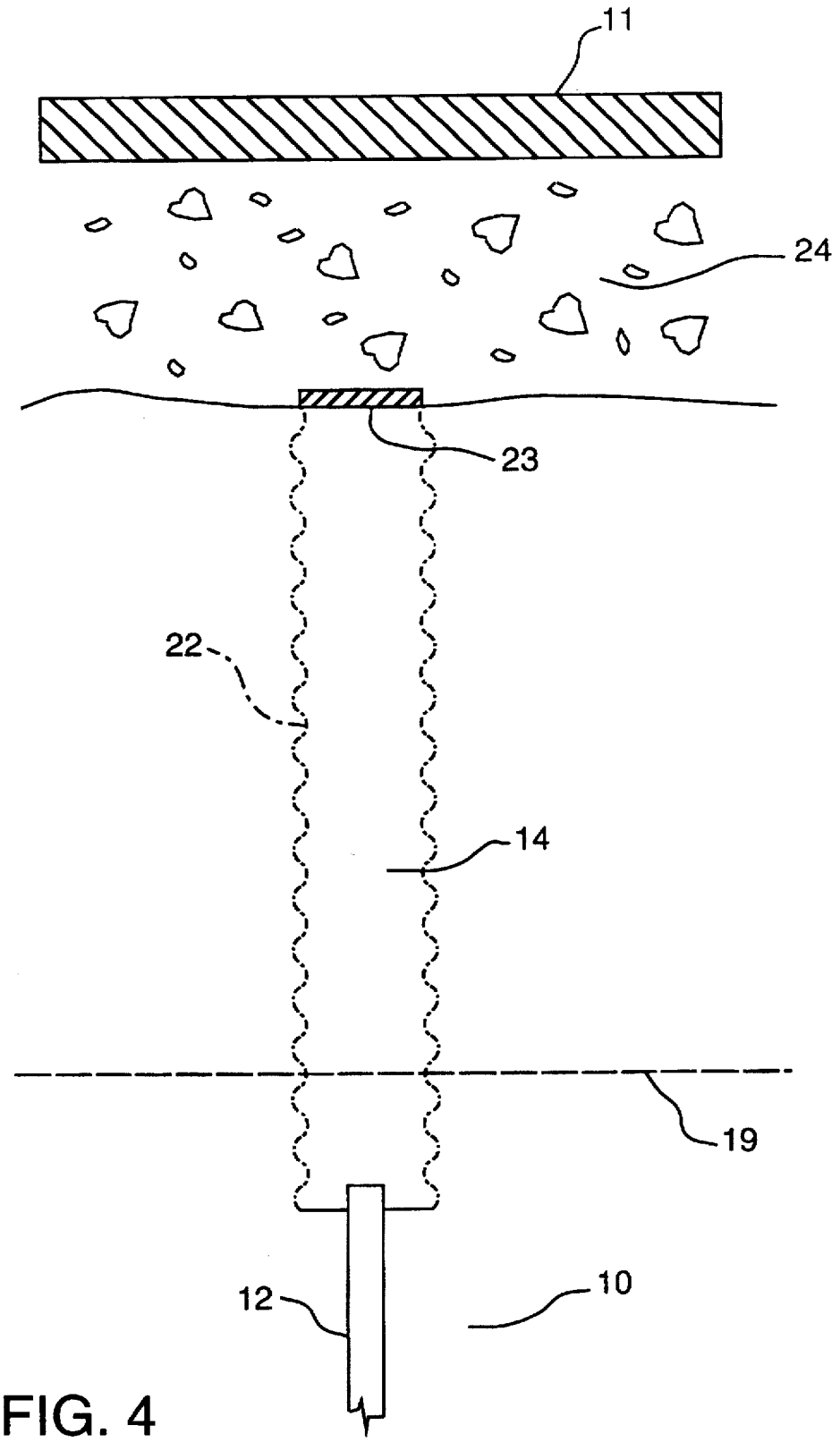
FIG. 4 is a schematic view in vertical cross section of an alternate reservoir construction consisting of a section of corrugated plastic, or other, pipe.

FIG. 4 shows a similarly created man-made reservoir. In this case a section of pipe 22 is embedded within the ground at each drain location. The drains 12 are arranged to terminate at their upper ends in the interior of this pipe. The top of the pipe is provided with an end cap or plug 23. The overlying structure or work 11 can be either placed on an intervening layer of fill 24 or placed directly on the tops of the embedded pipes 22. The pipes 22 could be of any number of materials, but normally would be constructed of corrugated plastic. The operation of this reservoir is identical in all other respects as described previously.

As previously indicated, a naturally occurring reservoir may be used in substitution of the man-made reservoir 14 of FIGS. 2, 3 and 4. This is schematically illustrated in FIG. 5.

Figure 5:
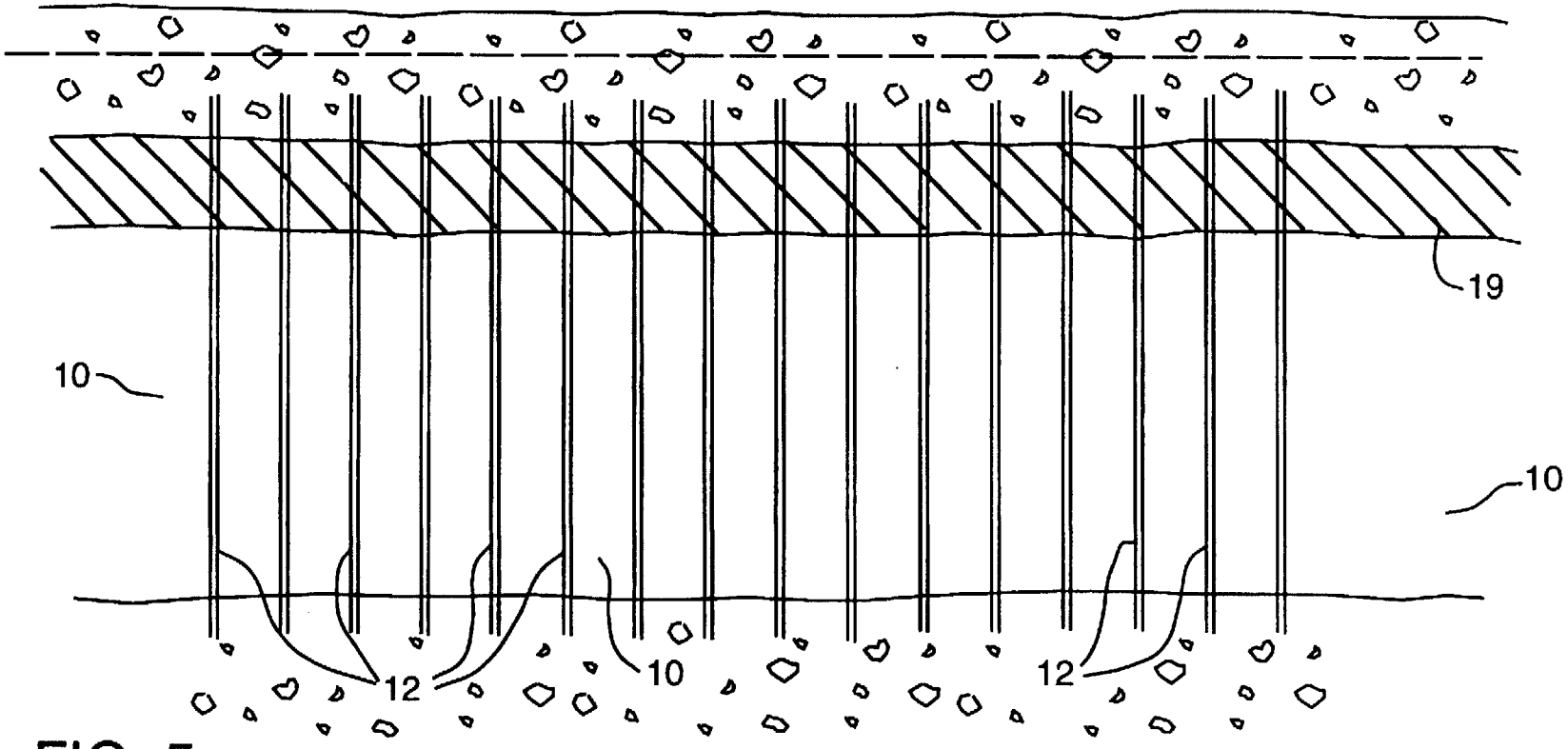
FIG. 5 is a schematic view in vertical cross section and frontal elevation illustrating remediation treatment of liquefiable soil in accordance with the teachings of the present invention with vertical composite drains in combination with reservoirs which are naturally present.

FIG. 5 illustrates a naturally occurring reservoir form of a highly permeable soil layer or aquifer 16 which underlies the treated liquefiable soil 10, or alternatively a highly permeable soil layer or aquifer 17 may overly the treated liquefiable soil. FIG. 5 is intended to represent either one of these naturally occurring reservoirs in the alternative, as it is not always likely that both such naturally occurring reservoirs would simultaneously be available for use at a given site. One or more impermeable soil layers 18 may exist between the treated liquefiable soil 10 and either an underlying aquifer 16 or an overlying aquifer 17. The static ground water level may or may not be located within an overlying aquifer.

The prefabricated composite drains 12 penetrate the liquefiable soil 10 and continue on to additionally penetrate the top of an underlying aquifer 16, such as coarse sand, thereunder. Thus, when excess pore water pressures are generated in the liquefiable soil 10 during an earthquake these pressures are readily relieved by water flow downwardly into the naturally occurring reservoir 16, thus preventing extreme excess pore water pressure buildup leading to liquefaction.

In a similar fashion, when the underlying reservoir 16 is not available, a highly permeable soil layer 17 may occur naturally above the liquefiable soil 10, and the pore water is permitted to drain upwardly through prefabricated drains 12.

In both cases, since hydrodynamic equilibrium will exist at the beginning of an earthquake, zero additional excess pressure will initially be required to deposit water in the reservoir. As water enters either reservoir 16 or 17 back pressures will be generated and a nominal amount of added pressure must be supplied to sustain the flow of water into the reservoirs. The amount of added pressure will depend of the amount of water flowing into the reservoir, and on the storage coefficient of the reservoir. This storage coefficient should be determined or estimated and considered in the design process.

The prefabricated composite drains of FIGS. 2, 3, 4 and 5 may also be utilized in combination with conventional concrete or steel piles which fully are at least partially coextend with the composite drains 12. For example, the composite drains may be laid into the side channels of piles with an I-beam cross section configuration, or they may be embedded into preformed concrete piles or positioned in cement or concrete. They may also be embedded in stone columns which are formed in situ. Various piling configurations may be utilized to provide either complete or partial reservoir requirements. The interior of steel pipe piling might be used for this purpose. Also specially designed precast concrete piling might contain void spaces for this purpose.

Figure 6:
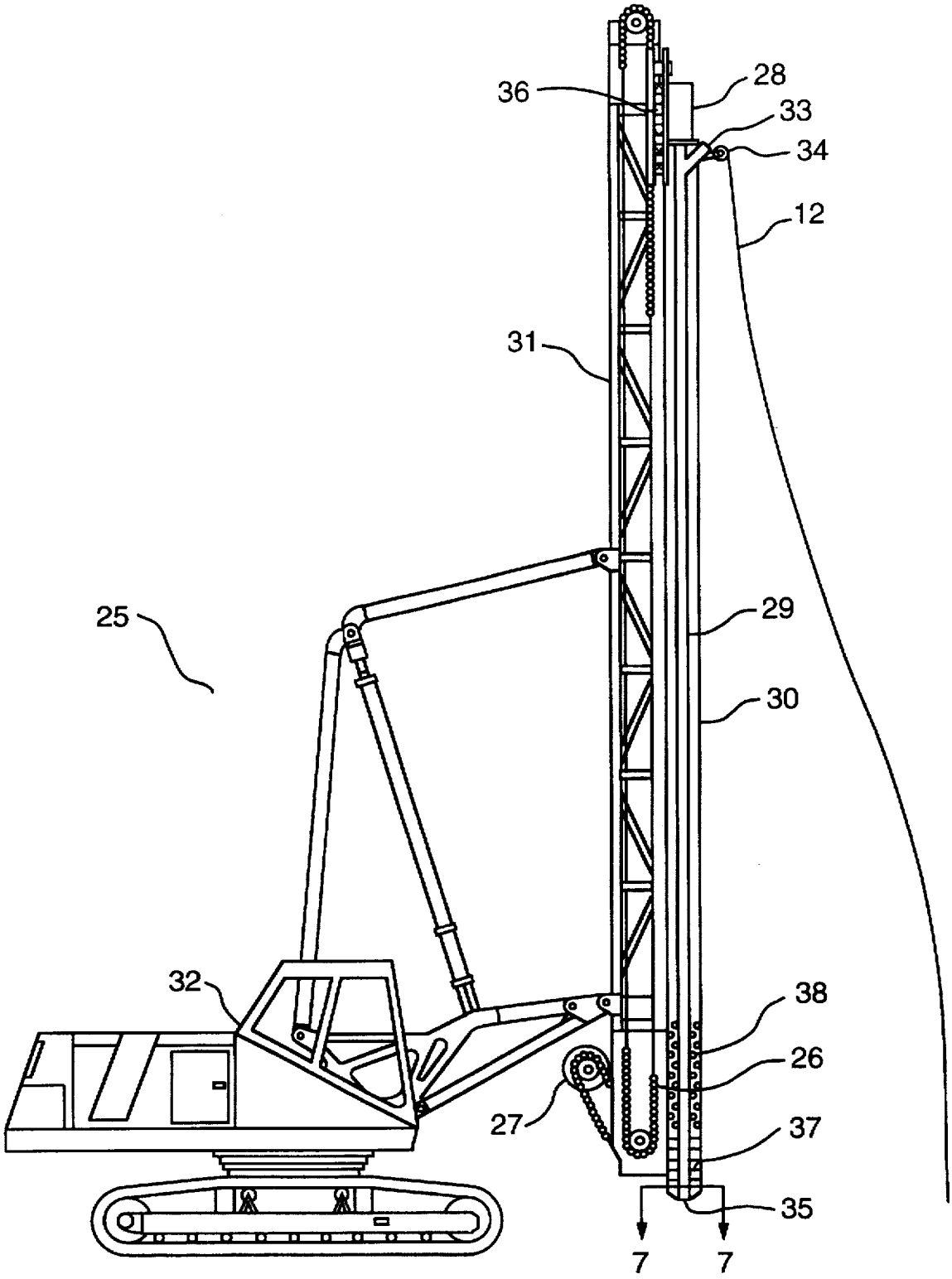
FIG. 6 is a schematic view of a typical wick drain installation rig adapted for installation of vertical prefabricated drains for liquefaction remediation.

In order to further enhance the liquefaction remediation of the liquefiable soil, the liquefiable soil may also be compacted by conventional means either before or after the vertical drains 12 are installed. Compaction may also be carried out simultaneously with drain installation. Illustrated in FIG. 6 is a conventional wick drain installation rig 25 adapted for installation of vertical composite drains for liquefaction remediation. As illustrated, an installation mast 31 is carried on some conventional piece of construction equipment 32. The mast 31 is fitted with a continuous loop of roller chain 26 on each side of the mast. These loops of roller chain are activated by a motor 27. A conventional vibratory driver 28 is attached to slide vertically on the front of the mast 31. This vibratory driver is coupled to the loops of roller chain 26 through special elastomers 36. These elastomers apply force to the vibratory driver to cause it to move vertically, but isolate vibrations from reaching the chain, mast and carrier equipment. The installation mandrel 29 is attached directly to the vibratory driver 28.

The drain 12 is carried inside the mandrel or insertion tube 29, and is driven downwardly into the earth to the desired depth. When this depth is reached the mandrel is withdrawn. A special sacrificial tip at the bottom of the mandrel 35 stays in place in the earth and is attached to and retains the composite drain 12 in place. As the mandrel is withdrawn, additional drain material feeds over a roller 34 and into an opening 33 to the interior of the mandrel 29. When the bottom of the mandrel is withdrawn from the earth, the exposed drain material 12 is cut, another sacrificial point is put in place, and the process is repeated at the next location.

In conventional wick drain installation the vibratory driver may or may not be used in the installation process. If the soil receiving the drains is soft enough, penetration can be accomplished by static crowd of the mandrel 29. Often hard layers are interbedded with or overly the soft soil, and penetration is difficult or impossible. In these cases the vibratory driver may be turned on to facilitate penetration of these hard layers.

Figure 7:
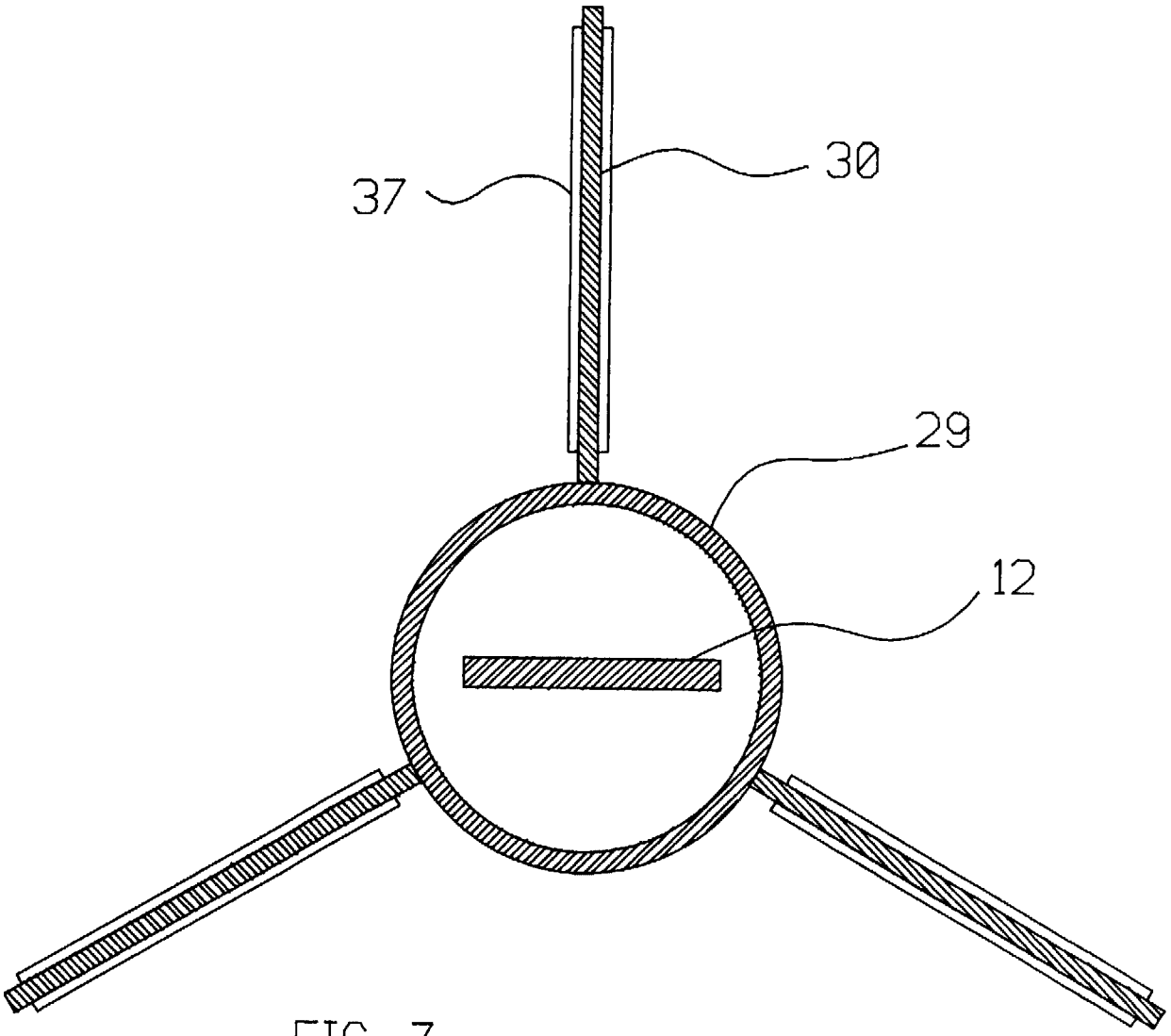
FIG. 7 is a cross section showing an installation mandrel fitted with "fins" for compaction of soil simultaneously with drain installation.

In the present invention fins 30 have been added to the mandrel 29. This is shown in cross section in FIG. 7. Three fins are shown but two or more could be utilized. The purpose of these fins is to transmit vibratory motion to the soil and thereby provide densification simultaneously with drain installation.

To facilitate transmission of vibratory motion to the soil, "cleats" or protrusions 37 may be added to the fins. Alternatively, holes 38 may be cut into the fins for this purpose as shown in FIG. 6.

PERFORMANCE ANALYSIS

Previously described prior art prefabricated wick drains are designed for, and perform very well in providing drainage that takes place slowly. Even under this slow drainage, head loss from movement of water within the drain may be a problem in drains that extend through very thick deposits of soft soil.

Consider a drain spacing of 7 feet. If 4 foot of settlement occurs in 3 months, the average flow rate through the drains will be about 0.0013 $ft^3$/min.

In order to gain some idea of the head loss within the drain under these conditions, reference may be taken from the Federal Highway Administration publication FHWA/RD-86/168. From this reference it can be seen that, for an "average" wick drain, at a confining pressure of 30 psi a discharge or flow of about 600 cubic meters per year will produce an hydraulic gradient of about unity. For the case of slow consolidation drainage, 0.0013 $ft^3$/min equates to about 19 $m^3$/year, and for most wick drains the hydraulic gradient would be roughly 0.03 ft/ft.

During an earthquake a settlement of say 1 inch may occur in 60 seconds (if the induced pore pressure ratio is approximately 0.6 to 0.7, the volumetric strain will be on the order of 0.3% to 0.4%). For a thickness of 30 feet, this amounts to about 1 inch of settlement.

For the case of the earthquake condition if the drains are spaced at 7 feet, the average flow rate through the drain is roughly 3.5 $ft^3$/min. This equates to about 52,000 $m^3$/year, and the hydraulic gradient would be roughly 87 ft/ft. Such head losses are obviously intolerable, and the use of any of the conventional wick drains is not feasible.

To gain some idea how the advanced prefabricated drain products (AKWADRAIN, HITEK, ADS, etc.) might function as vertical drains for liquefaction protection in accordance with the teachings of the present invention, as compared with gravel drains or stone columns, consider the example problem presented by Seed and Booker. This example considers a soil layer having permeability $k=10^{-5}$ m/s ($3.25\times10^{-5}$ ft/s, which corresponds to very fine sand or silty sand—see Table I), and $m_{v3}$ (coefficient of volume compressibility)$=2\times10^{-6}$ $ft^2$/lb (corresponds to loose soil). This soil is subjected to an earthquake which can be considered as applying 24 uniform stress cycles in a period of 70 seconds. The characteristics of the soil are such that liquefaction would occur after 12 cycles if no drainage were provided.

Problem geometry as shown on FIG. 2 was assumed. The thickness 13 of the liquefiable soil 10 was taken to be 30 feet. An overlying nonliquefiable layer 8 was assumed with a thickness 9 of 5 feet, and the static ground water table 19 was assumed to be 2 feet above the liquefiable soil (i.e. thickness 20 is 3 feet). The initial effective overburden at the top of the soft soil was taken as 800 lb/$ft^2$.

Results were obtained using the computer program EQDRAIN. The method utilized by this program is to break the liquefiable soil layer into sublayers. Generation of pore water pressures due to seismic shaking is computed for each sublayer according to the same scheme used in program LARF (as proposed by Seed & Booker). The flow into the drains from each sublayer is monitored, and head losses from cumulative vertical flow within the drains are calculated. Also head losses in the portions of the drains above the liquefiable layer are monitored, as well as the water level in the drains or reservoir. The cumulative effect of these sources of back pressure is computed, and applied for each sublayer. Time zero is assumed at the beginning of seismic activity. Static ground water conditions are assumed initially, and the water level in the drains is at the level 19. The above calculations are performed at time zero, and repeated for some predetermined time interval. The process is continued for any desired length of time.

Results from program EQDRAIN were checked with those from program LARF to the extent possible. Agreement was excellent.

Head losses from water flow in the drains are computed according to Darcy's law for stone columns or gravel drains, according to Manning's equation for corrugated pipe, and for AKWADRAIN according to $$i=C_1Q^n$$

where $C_1$ and n are experimentally determined constants. Head losses from flow through the geotextiles are computed according to the manufacturer's published permitivity values. Head loss through slits or perforations, in the case of perforated pipe, are computed as $$h_l=\frac{v^2}{2g}$$

where v is the flow velocity through the slit or perforation and g is the gravitational constant. For the corrugated pipe, Manning's n-value was taken as 0.015. For all cases the geofabric was considered to be AMOCO STYLE 4545 geofabric with a permitivity of 0.333 $ft^3$/sec/$ft^2$/ft. For 4-inch diameter corrugated pipe the orifice area of the slits was taken as 1.90 $in^2$/ft of pipe. For 2"×12" AKWADRAIN the equivalent diameter was taken as the diameter of a circle with circumference equal to that of the drain, 0.74 feet, and the empirical flow constants according to the manufacturer are $$i=19.30Q^{1.8}$$

where Q is in cfs. For wick drains, parameters were estimated based on the aforementioned Federal Highway Administration publication FHWA/RD-86/168. The permeability of clean, gravel can range from about 1 to 100 cm/sec. Depending on the installation method, considerable contamination of the gravel material is possible during the construction of either stone columns or gravel drains. Thus, choosing an appropriate permeability for these materials is difficult. For comparison purposes, calculations were performed for permeabilites of 1, 10, and 100 cm/sec.

Vertical drain spacing is normally designed to limit maximum pore pressure ratios, $r_\omega$to a value of 0.6. The pore pressure ratio at any point is defined as the pore water pressure, u, divided by the initial effective overburden stress, $\sigma_y'$

TABLE II

Drain Spacings to Produce $(r_u)_{max}$ of 0.6.

| | |
|---|---|
| Earthquake: | Equivalent No. Cycles = 24<br>Duration = 70 seconds |
| Soil: | $k = 0.325 \times 10^{-4}$ ft/sec<br>$m_v = 0.2 \times 10^{-5}$ ft²/sec<br>No. cycles to liquefaction = 12 |

| Drain | Spacing Triangular (feet) | Settlement 70 seconds (inches) | Height water in drain | Cost per sq ft |
|---|---|---|---|---|
| Stone 3' dia k = 1 cm/sec | 7.54 | 0.86 | 2 | $10.35 |
| Stone 3' dia k = 10 cm/sec | 8.17 | 0.95 | 2.59 | 8.82 |
| Stone 3' dia k = 100 cm/sec | 8.24 | 0.96 | 2.67 | 8.67 |
| Stone 1' dia k = 1 cm/sec | 3.29 | 0.89 | 3.06 | 9.63 |
| Stone 1' dia k = 10 cm/sec | 4.86 | 1.02 | 3.17 | 4.41 |
| Stone 1' dia k = 100 cm/sec | 5.14 | 1.07 | 3.19 | 3.93 |
| Corrugated pipe 4" ID | 4.14 | 1.08 | 3.22 | 2.62 |
| AKWA 2" × 12" | 4.68 | 1.07 | 3.2 | 2.53 |
| Wick Drain ⅛" × 4" | 0.65 | 0.88 | 3.15 | 33.04 |

Table II lists the results of these calculations. The per square foot treatment costs were based on typical costs as follows:

| | |
|---|---|
| Three-foot diameter stone columns | Typical cost $17.00/foot |
| One-foot diameter gravel drain | 3.00/foot |
| Four-inch I.D. corrugated pipe | 1.30/foot |
| 2" × 12" AKWA drain | 1.60/foot |
| Wick drains | 0.40/foot |

The drastic effect of changes in the permeability of gravel material for stone columns and gravel drains is obvious, particularly for the 1-foot diameter gravel drains. The cost of treatment per square foot for this case varies from $10.35 to $8.67 for 3-foot diameter stone columns, and from $9.63 to $3.93 for 1-foot diameter gravel drains. Quality control in the construction of these products is important, but often difficult to achieve in practice. Installing a composite drain centrally in either a stone column or gravel drain would assure that the required flow capacity is achieved. For instance, if a 4-inch corrugated plastic pipe were installed in a 1-foot diameter gravel drain the spacing could be increased to approximately 5.2 feet, even if the stone material had a permeability of 1 cm/sec or less.

The efficiency of the advanced drainage products is also evident, with a cost treatment of $2.53 per square foot for AKWA drain and $2.62 per square foot for corrugated pipe. The extremely high cost for wick drains is because of their very low flow capacity, necessitating a small spacing.

Table II presents a comparison of results of one particular case only, and results for other conditions could be expected to vary drastically. For instance, if the distance 20 is greater than roughly 3 to 6 feet the water rise in the prefabricated drainage products becomes relatively larger. This exerts more back pressure on pore water trying to enter the drain, and smaller drain spacings are necessary. In this case the use of a reservoir of the type shown on FIGS. 3 or 4 may be cost effective.

Novelties of this approach include the concept of using composite drains for liquefaction remediation, the concept of a reservoir (man-made or natural), applicable to both composite and gravel or sand drains, the possible use of a composite drain with either gravel or sand drains, and combining soil densification through vertical vibration of a modified probe with drain installation.

I claim:

1. Apparatus for treating liquefiable soil for earthquake liquefaction protection for a structure or work on or below an overlying ground surface with an initial static ground water level in soil underlying said ground surface, comprising:

a plurality of substantially vertical prefabricated drains positioned at spaced intervals in the liquefiable soil, and a reservoir located below said overlying ground surface for draining off water expelled from said drains.

2. The apparatus of claim 1, said liquefiable soil having a permeability in the approximate range of $1\times10^{-1}$ to $1\times10^{-7}$ cm/sec.

3. The apparatus of claim 2, said drains comprised of an elongated plastic core providing channels therein for channeling water.

4. The apparatus of claim 3, said elongated plastic core surrounded by filter fabric.

5. The apparatus of claim 4, said elongated plastic core including a flexible strip having lateral stand-off protrusions providing drainage channels therebetween.

6. The apparatus of claim 3, said elongated plastic core including corrugated and perforated plastic pipe.

7. The apparatus of claim 3, said drains spaced in the range of approximately 2 to 6 feet from each other.

8. The apparatus of claim 7, said drains fully penetrating said liquefiable soil.

9. The apparatus of claim 1, said reservoir consisting of a naturally available reservoir.

10. The apparatus of claim 9, said naturally available reservoir comprised of highly permeable soil underlying said treated liquefiable soil.

11. The apparatus of claim 9, said naturally available reservoir comprised of a highly permeable soil overlying said treated liquefiable soil.

12. The apparatus of claim 1, said reservoir comprised of a layer of high permeability soil applied over said liquefiable soil.

13. The apparatus of claim 1, said drains including elongated piles incorporating said drains therein in combination, said drains comprised of plastic core material selectively surrounded by filter fabric.

14. A method for treating liquefiable soil for earthquake liquefaction protection for a structure or work on or below an overlying ground surface with an initial static ground water level in soil underlying said ground surface, comprising the steps of:

inserting prefabricated drains in substantially vertical fashion into the liquefiable soil at predetermined spaced intervals, and draining water expelled from said drains during an earthquake to a reservoir located below said overlying ground surface.

15. The method of claim 14 wherein the liquefiable soil being treated has a permeability in the approximate range of $1\times10^{-1}$ to 1×10–7 cm/sec.

16. The method of claim 15, including the step of fabricating said drains of an elongated plastic core providing channels therein for channeling water therealong.

17. The method of claim 16, including the step of surrounding said elongated plastic core with filter fabric.

18. The method of claim 17, including the step of constructing said elongated plastic core from flexible strip material having lateral stand-off protrusions for providing said water channels therebetween.

19. The method of claim 16, including the step of constructing said elongated plastic core of corrugated and perforated plastic pipe.

20. The method of claim 16, including the step of spacing said drains in the range of approximately two to six feet from each other.

21. The method of claim 20, including the step of fully penetrating said liquefiable soil with said drains.

22. The method of claim 14, including the step of providing said reservoir in the form of a naturally available reservoir.

23. The method of claim 22, wherein said naturally available reservoir is provided in the form of a highly permeable soil which underlies the liquefiable soil being treated.

24. The method of claim 22, wherein said naturally available reservoir is provided by utilizing a naturally highly permeable soil which overlies the liquefiable soil being treated.

25. The method of claim 14, including the step of providing said reservoir by applying reservoir means over said drains.

26. The method of claim 25, wherein said reservoir means is applied by applying lightly permeable soil layer over said drains.

27. The method of claim 25, wherein said reservoir means is applied by positioning reservoir pipes over said drains and under said ground surface with a substantial portion of said pipes above the initial static ground water level found in said soil.

28. The method of claim 14, wherein said reservoir is constructed by providing a layer of high permeability soil overlying said liquefiable soil.

29. The method of claim 14, including the steps of incorporating said drains therein in combination with elongated piles.

30. The method of claim 14, including the step of enhancing compactions of said liquefiable soil either before or after inserting said drains.

31. The method of claim 14, including the step of compacting said liquefiable soil during the step of inserting said drains.

* * * * *